United States Patent [19]

Charrier et al.

[11] Patent Number: 4,608,860

[45] Date of Patent: Sep. 2, 1986

[54] STALL DETECTOR

[75] Inventors: Michael G. Charrier, Cincinnati, Ohio; Peter G. Smith, Daphne, Ala.

[73] Assignee: General Electric Company, Cincinnati, Ohio

[21] Appl. No.: 750,125

[22] Filed: Jul. 1, 1985

[51] Int. Cl.[4] ..... G01M 15/00

[52] U.S. Cl. ..... 73/115; 73/116; 340/966

[58] Field of Search ..... 73/115, 116, 714; 116/266; 340/959, 960, 966

[56] References Cited

U.S. PATENT DOCUMENTS 3,867,717 2/1975 Moehring et al. ..... 340/966 X 4,216,672 8/1980 Henry et al. ..... 73/115

*Primary Examiner*—Jerry W. Myracle

*Attorney, Agent, or Firm*—Gregory A. Welte; Derek P. Lawrence

[57] ABSTRACT

Compressor discharge pressure (CDP) in a gas turbine engine is sensed. A fall in CDP is interpreted as indicating compressor stall.

3 Claims, 1 Drawing Figure

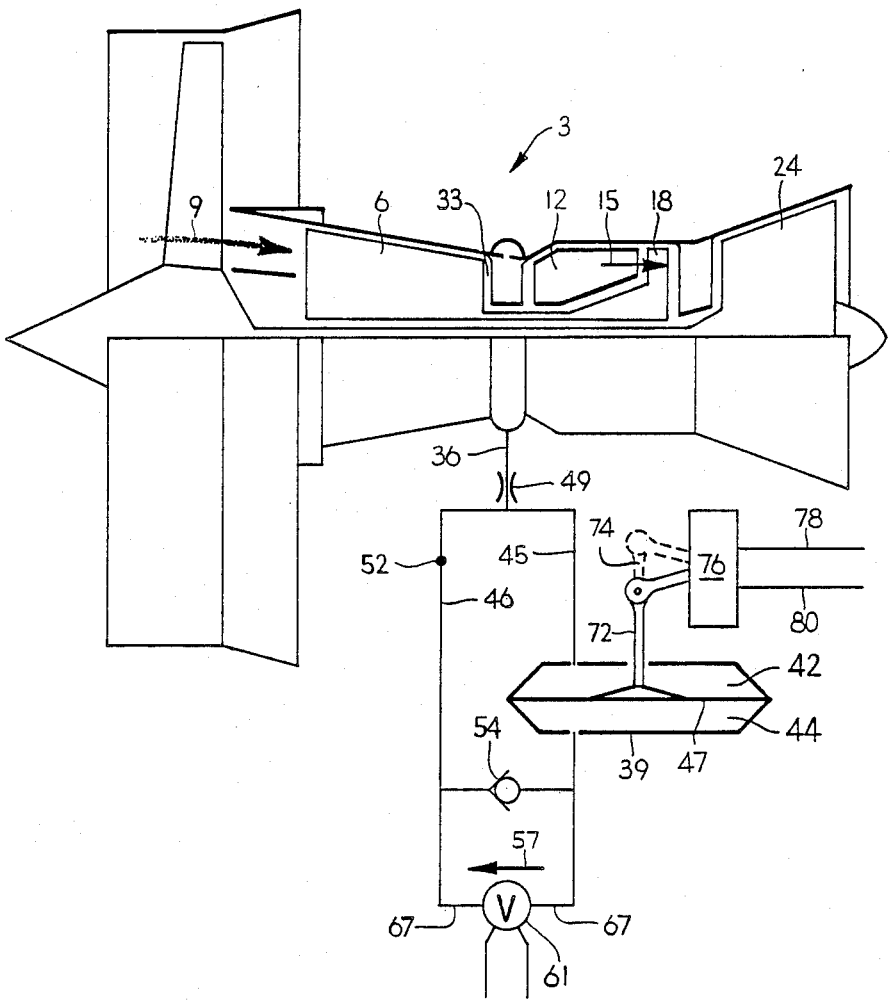
3
24
9
6
33
12
15
18
36
49
74
78
52
45
76
46
80
72
42
44
54
39
47
57
67
67
61
V

STALL DETECTOR

The present invention relates to a stall detector for a gas turbine engine.

BACKGROUND OF THE INVENTION

Stall can occur in the compressor stage of a gas turbine engine. Compressor stall can cause a temperature rise in the low pressure turbine with possible turbine damage. In some types of engines, compressor stalls only occur during engine startup.

OBJECTS OF THE INVENTION

It is an object of the present invention to provide a stall sensor for a gas turbine engine.

SUMMARY OF THE INVENTION

In one form of the present invention, compressor discharge pressure (CDP) in a gas turbine engine is sensed. A fall in CDP is interpreted as indicating compressor stall.

BRIEF DESCRIPTION OF THE DRAWING

FIG. 1 illustrates one form of the present invention.

DETAILED DESCRIPTION OF THE INVENTION

A gas turbine engine 3 has a compressor stage 6 which compresses incoming air 9 and delivers the compressed air to a combustor stage 12. The engine adds fuel to the compressed air in the combustor stage 12. The fuel burns and produces a high energy, hot gas stream 15 which flows through a high pressure turbine 18. Then, the hot gas stream 15 flows through a low-pressure turbine 24.

The occurrence of compressor stall causes the compressor discharge pressure (CDP) to drop. CDP is the pressure approximately at point 33. The present invention detects this pressure drop as follows. A line 36 taps CDP and ports it to a sealed container 39 which is divided into two chambers 42 and 44 by a diaphragm 47. Line 36 splits into two feeder lines 45 and 46 which respectively connect to chambers 42 and 44. A constriction 49 in the line 36 functions to reduce a CDP loss if a break should occur downstream of the restriction 49 such as at point 52. A check valve 54 prevents flow in the direction of arrow 57. A solenoid valve 61, when open, allows flow through line 67 but, when closed, prevents such flow.

When CDP is rising, as during engine startup, gas flows through lines 45 and 46 into chambers 42 and 44. Solenoid 61 is closed. Thus, equal pressures occur in chambers 42 and 44. (The pressure drop across check valve 54 is minimal and does not significantly affect the pressure in chamber 44). However, if CDP should fall, check valve 54 closes, the pressure in chamber 42 will fall below that of chamber 44, and the diaphragm 47 will deflect, pushing a link 72 to dashed position 74. This deflection will activate a switch 76 and thus carry a signal along leads 78 and 80 to the cockpit of the aircraft to thereby warn the pilot of the occurrence of a stall.

After the engine 3 has been successfully started, the solenoid 61 is opened to thereby allow flow through line 67. Under this condition, the pressure in chambers 42 and 44 will necessarily be equal and the present invention is rendered inactive.

A stall sensor has been described in which a drop in compressor discharge pressure during engine startup is detected. Chamber 44 operates as an accumulator to store CDP. (The check valve 54 assures that the pressure in chamber 44 does not decrease, when solenoid 61 is closed, thus allowing chamber 44 to operate as an accumulator.) If CDP should subsequently drop below the accumulated value, a wall of the chamber 44 (in the form of diaphragm 47) deforms to thereby activate switch 76. The diaphragm 47 thus acts as a sensor to detect a drop in CDP. The switch 76 acts as an indicator of the drop in CDP.

Applicants point out that the present invention responds only to a drop in CDP, and not to a failure of CDP to continually increase, as in the case of a pressure sequence of 5, 10, 15, 15, followed by a stable CDP of 15 psi. However, Applicants believe that the failure of CDP to increase is not indicative of compressor stall because, in stall, the compressor efficiency drops, causing CDP to drop. Applicants believe that the lack of response of the present invention to a leveling off of CDP is an artifact of no consequence.

Numerous substitutions and modifications can be undertaken without departing from the true spirit and scope of the present invention.

What is desired to be secured by Letters Patent is the invention as defined in the following claims.

We claim:

1. A sensor for a gas turbine engine having a Compressor Discharge Pressure (CDP), comprising:

(a) accumulator means for accumulating CDP;

(b) sensing means for sensing a drop in CDP below the accumulated CDP; and (c) indicator means for producing a signal in response to the drop in CDP when sensed.

2. A sensor for detecting stall in a gas turbine engine, comprising:

(a) a sealed container;

(b) a diaphragm for dividing the container into two chambers;

(c) a first line for porting compressor discharge pressure (CDP) into the first chamber;

(d) a second line for porting CDP into the second chamber;

(e) a check valve interconnected in the second line for maintaining pressure in the second chamber; and (f) switch means coupled to the diaphragm for detecting deflection of the diaphragm occurring when the pressure in the second chamber exceeds the pressure in the first chamber.

3. A sensor according to claim 2 and further comprising a valve for connecting the first chamber with the second chamber to thereby equalize the pressures in both.

* * * * *